US009756876B2

(12) United States Patent
Liu

(10) Patent No.: US 9,756,876 B2
(45) Date of Patent: Sep. 12, 2017

(54) ELECTRONIC CIGARETTE DEVICE

(71) Applicant: KIMREE HI-TECH INC., Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 0 days.

(21) Appl. No.: 14/118,798

(22) PCT Filed: Sep. 3, 2013

(86) PCT No.: PCT/CN2013/082841

§ 371 (c)(1),
(2) Date: Nov. 19, 2013

(87) PCT Pub. No.: WO2015/021675

PCT Pub. Date: Feb. 19, 2015

(65) Prior Publication Data

US 2016/0150821 A1 Jun. 2, 2016

(30) Foreign Application Priority Data

Aug. 15, 2013 (CN) ..... 2013 2 0499697 U

(51) Int. Cl.
*A24F 47/00* (2006.01)

(52) U.S. Cl.
CPC ..... *A24F 47/002* (2013.01); *A24F 47/008* (2013.01)

(58) Field of Classification Search
None
See application file for complete search history.

(56) References Cited

U.S. PATENT DOCUMENTS 8,499,766 B1 8/2013 Newton
2013/0192615 A1* 8/2013 Tucker ..... H01C 17/00 131/328

(Continued)

FOREIGN PATENT DOCUMENTS

CN 201072979 Y 6/2008
CN 101843368 A 9/2010

(Continued)

OTHER PUBLICATIONS

International Search Report for the PCT Application No. PCT/CN2013/082841, dated May 28, 2014. No English translation available.

(Continued)

*Primary Examiner* — Michael H Wilson
*Assistant Examiner* — Katherine Will
(74) *Attorney, Agent, or Firm* — Yue Xu; U.S. Fairsky LLP

(57) ABSTRACT

An electronic cigarette device may include a first outer electrode provided on the assembly end of the atomizer. At least one air hole may be provided at the rear of the first outer electrode. A second outer electrode may be provided on the assembly end of the battery rod. An electrode fixation base may be provided coaxially with and rotatable around a fixed axis with the first outer electrode is provided inside the second outer electrode. An air groove may be provided at the outer end surface of the assembly end of the battery rod, and is in one-to-one correspondence with and is adapted to be coaxial with the air hole. At least one protruding rib extending along the axial direction of the atomizer may be provided on the outer circumference surface of the first outer electrode.

4 Claims, 1 Drawing Sheet

(56) References Cited

U.S. PATENT DOCUMENTS

| | | | | |
|---|---|---|---|---|
| 2013/0192617 | A1 | 8/2013 | Thompson | |
| 2014/0150810 | A1* | 6/2014 | Hon | A24F 47/008 131/329 |

FOREIGN PATENT DOCUMENTS

| | | | |
|---|---|---|---|
| CN | 201781984 | U | 4/2011 |
| CN | 202005248 | U | 10/2011 |
| CN | 202127820 | U | 2/2012 |
| CN | 202276832 | U | 6/2012 |
| WO | 2012142293 | A2 | 10/2012 |

OTHER PUBLICATIONS

European Search Report for 13891403.1-1656/3033953, mailed Feb. 24, 2017.

* cited by examiner

ELECTRONIC CIGARETTE DEVICE

This application is the US national phase of International Application No. PCT/CN2013/082841 filed on Sep. 3, 2013, which claims the benefit of priority to Chinese patent application No. 201320499697.2 titled "ELECTRONIC CIGARETTE DEVICE" and filed with the Chinese State Intellectual Property Office on Aug. 15, 2013, the entire disclosure of which is incorporated herein by reference

BACKGROUND OF THE INVENTION

The present application relates to the technical field of the emulation equipment of the cigarette, and particularly to an electronic cigarette device.

The electronic cigarette is a common electronic emulation product of cigarette. With ever increasing requirements of usage, users impose a higher requirement on the performance of the electronic cigarette.

A current conventional electronic cigarette generally includes an atomizer and a battery rod. In general, the atomizer and the battery rod are assembled and fixed through threaded connection. However, though such assembly structure could meet a basic requirement of usage of the electronic cigarette, since a precision of assembly position after screwing tightly is worse, it is impossible to achieve a stable and accurate alignment between an air hole located at the assembly end of the atomizer and an air groove located at the assembly end of the battery rod. As a result, in use of the assembled electronic cigarette, a noise tends to be generated, not only influencing user's experience, but also bringing inconveniences in a normal usage of the electronic cigarette.

Thus, an important technical problem to be solved presently by those skilled in the art is to realize a stable and accurate aligning assembly between the air hole and the air groove of the electronic cigarette.

SUMMARY OF THE INVENTION

An object of the present application is to provide an electronic cigarette device, in which there is a stable and accurate aligning assembly between an air hole and an air groove.

To solve the above technical problem, there is provided in the present application an electronic cigarette device, including an atomizer and a battery rod which are connected with each other, wherein a first outer electrode is provided on an assembly end of the atomizer, at least one air hole is provided at the rear of the first outer electrode, a second outer electrode is provided on an assembly end of the battery rod, a socket adaptedly fitted with the first outer electrode is provided on the second outer electrode, an electrode fixation base is provided inside the second outer electrode, and is provided coaxially with and is rotatable around a fixed axis with the first outer electrode, at least one air groove is provided at an outer end surface of the assembly end of the battery rod, and the at least one air groove and the at least one air hole are in a configuration of aligning assembly; and wherein at least one protruding rib is provided on an outer circumference surface of the first outer electrode and extends along an axial direction of the atomizer, at least one locating groove is provided on an inner wall of the electrode fixation base and extends along a circumference direction of the battery rod and is in one-to-one correspondence with the at least one protruding rib, the at least one protruding rib is rotatablely engaged with the at least one locating groove, and is rotatable in the circumference direction of the battery rod.

Preferably, the first outer electrode and the socket each have an elliptical cross section, and the number of each of the protruding rib and the locating groove is two. The protruding ribs are specifically flange sections located at long axis ends of the cross section of the first outer electrode.

Preferably, the air hole is in any one of the following shapes: round, square, ellipse, triangle, or polygon.

Preferably, a cross-sectional area of the air hole is ranged from 0.5 square millimeter to 4 square millimeters.

Preferably, a cross-sectional area of the air groove is ranged from 0.5 square millimeter to 4 square millimeters.

Compared with the above background technique, the electronic cigarette device according to the present application includes an atomizer and a battery rod which are connected with each other, wherein a first outer electrode is provided on the assembly end of the atomizer, at least one air hole is provided at the rear of the first outer electrode, a second outer electrode is provided on the assembly end of the battery rod, a socket adaptedly fitted with the first outer electrode is provided on the second outer electrode, an electrode fixation base is provided inside the second outer electrode, and is rotated about a fixed axis with and mounted coaxially with the first outer electrode; at least one air groove is provided at the outer end surface of the assembly end of the battery rod, and is in one-to-one with and is adapted to be coaxial with the air hole; at least one protruding rib extending along the axial direction of the atomizer is provided on the outer circumference surface of the first outer electrode, and a locating groove in one-to-one correspondence with the protruding rib is provided in the inner wall of the electrode fixation base and extends along the circumference direction of the battery rod; and the protruding rib is rotatablely engaged with the locating groove, and is rotated in the circumference direction of the battery rod. In operation, the first outer electrode is inserted into the socket and mounted in the electrode fixation base, and the protruding rib is engaged in the locating groove and is rotated around a fixed axis along an extending direction of the locating groove, such that a coaxial locating between the air hole and the air groove is realized. A rotation angle of the protruding rib and an ultimate assembly position thereof could be limited by the locating groove, and thereby an accurate aligning assembly between the air hole and the air groove could be implemented stably in any assembly process between the atomizer and the battery rod.

In another preferable solution according to the present application, the cross section of the first outer electrode and the cross section of the socket each are elliptic, and there are two protruding ribs and two locating grooves. The protruding ribs are specifically flange sections located at the long axis ends of the cross section of the first outer electrode. The first outer electrode with a elliptic cross section and the protruding rib form into one piece, thereby further enhancing a structural strength of the first outer electrode, enabling a more stable and reliable assembly structure between the first outer electrode and the second outer electrode as well as the electrode fixation base, and thus further enhancing stability and accuracy of the aligning assembly between the air hole and the air groove.

BRIEF DESCRIPTION OF THE DRAWINGS

In order to clearly illustrate embodiments of the present application or technical solutions in the prior art, drawings required for the description of the embodiments or the prior art will be briefly introduced below. Apparently, the drawings described below simply refer to some embodiments of the present application, and those skilled in the art may obtain other drawings, based on the following drawings, without any creative work.

DETAILED DESCRIPTION

An object of the present application is to provide an electronic cigarette device, in which there is a stable and accurate aligning assembly between an air hole and an air groove.

In order that those skilled in the art can better understand technical solutions according to the present application, the present application will be explained in detail in conjunction with the accompanying drawings and the embodiments below.

Figure 1:
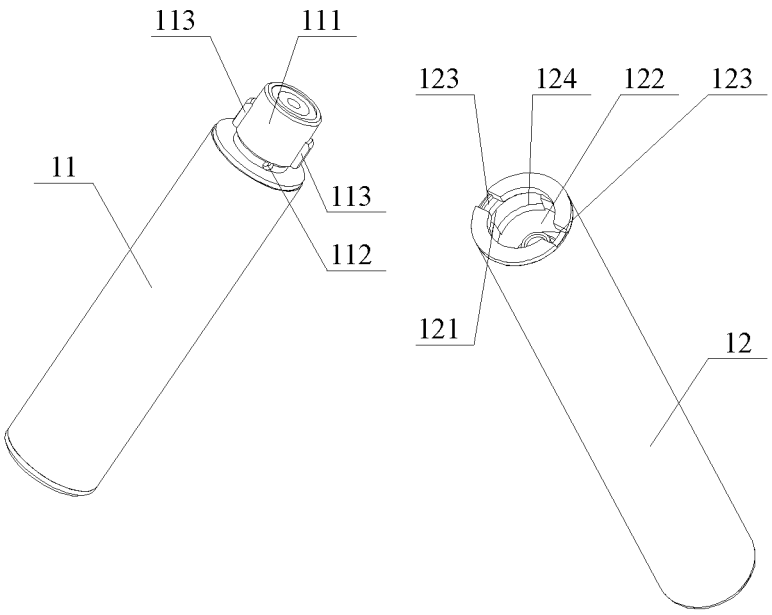
FIG. 1 is an unassembled structural schematic view illustrating a structure of an electronic cigarette device according to an embodiment of the present application.

Referring to FIG. 1, it is an unassembled structural schematic view illustrating a structure of an electronic cigarette device according to an embodiment of the present application.

In an embodiment, an electronic cigarette device according to the present application includes an atomizer 11 and a battery rod 12 which are connected with each other. A first outer electrode 111 is provided on the assembly end of the atomizer 11, and at least one air hole 112 is provided at the rear of the first outer electrode 111. A second outer electrode 121 is provided on the assembly end of the battery rod 12, and a socket (not shown) adapted for the first outer electrode 111 is provided on the second outer electrode 121. An electrode fixation base 122 is provided inside the second outer electrode 121, and is rotated about a fixed axis with and mounted coaxially with the first outer electrode 111. At least one air groove 123 is provided at the outer end surface of the assembly end of the battery rod 12, and is in one-to-one with and is adapted to be coaxial with the air hole 112. At least one protruding rib 113 extending along the axial direction of the atomizer 11 is provided on the outer circumference surface of the first outer electrode 111, and a locating groove 124 in one-to-one correspondence with the protruding rib 113 is provided in the inner wall of the electrode fixation base 122 and extends along the circumference direction of the battery rod 12. The protruding rib 113 is rotatablely engaged with the locating groove 124, and is rotated in the circumference direction of the battery rod 12. In operation, the first outer electrode 111 is inserted into the socket and mounted in the electrode fixation base 122, and the protruding rib 113 is engaged in the locating groove 124 and is rotated around a fixed axis along an extending direction of the locating groove 124, such that a coaxial locating between the air hole 112 and the air groove 123 is realized. A rotation angle of the protruding rib 113 and an ultimate assembly position thereof could be limited by the locating groove 124, and thereby an accurate aligning assembly between the air hole 112 and the air groove 123 could be implemented stably in any assembly process between the atomizer 11 and the battery rod 12.

Figure 2:
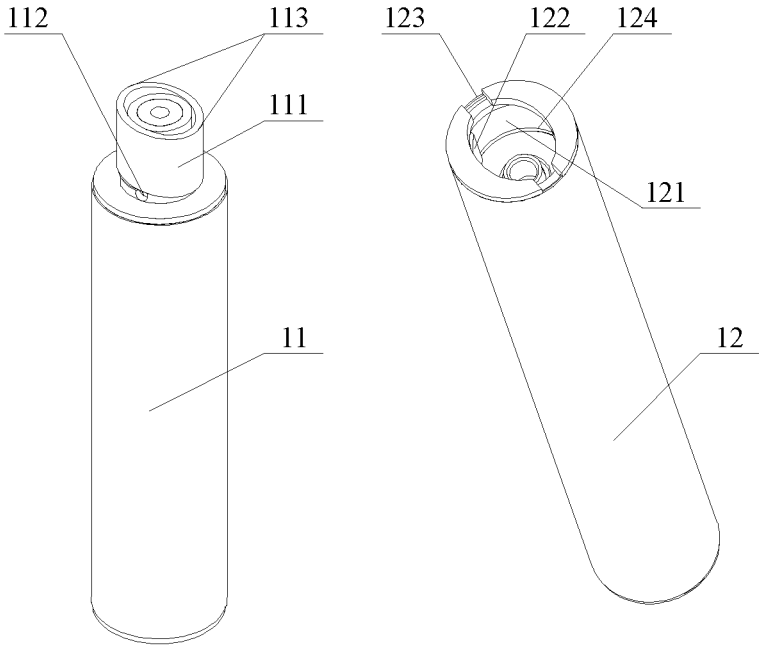
FIG. 2 is an unassembled structural schematic view illustrating another structure of an electronic cigarette device according to an embodiment of the present application.

Referring to FIG. 2, it is an unassembled structural schematic view illustrating another structure of an electronic cigarette device according to an embodiment of the present application.

On the other hand, the cross section of the first outer electrode 111 and the cross section of the socket each are elliptic, and there are two protruding ribs 113 and two locating grooves 124. The protruding ribs 113 are specifically flange sections located at the long axis ends of the cross section of the first outer electrode 111. The first outer electrode 111 with a elliptic cross section and the protruding rib 113 form into one piece, thereby further enhancing a structural strength of the first outer electrode 111, enabling a more stable and reliable assembly structure between the first outer electrode 111 and the second outer electrode 121 as well as the electrode fixation base 122, and thus further enhancing stability and accuracy of the aligning assembly between the air hole 112 and the air groove 123.

It should be noted that, the cross section of the first outer electrode 111 and the cross section of the socket each preferably are in ellipse shape, but not limited to the ellipse shape shown in the drawings, and may be in any shape which meets an actual usage requirement of the electronic cigarette device.

Further, the air hole 112 is in any one of the following shapes: round, square, ellipse, triangle, or polygon. The shape of the air hole 112 is not limited to those described above certainly, as long as it meets an actual usage requirement of the electronic cigarette device.

More specifically, a cross-sectional area of the air hole 112 is ranged from 0.5 square millimeter to 4 square millimeters; and a cross-sectional area of the air groove 123 is ranged from 0.5 square millimeter to 4 square millimeters. It should be noted that, the cross-sectional area ranged from 0.5 square millimeter to 4 square millimeters of both the air hole and the air groove is preferable, but not limited to the above range, as long as it meets an actual usage requirement of the electronic cigarette device.

In summary, the electronic cigarette device according to the present application includes an atomizer and a battery rod which are connected with each other, wherein a first outer electrode is provided on the assembly end of the atomizer, at least one air hole is provided at the rear of the first outer electrode, a second outer electrode is provided on the assembly end of the battery rod, a socket adaptedly fitted with the first outer electrode is provided on the second outer electrode, an electrode fixation base is provided inside the second outer electrode, and is rotated about a fixed axis with and mounted coaxially with the first outer electrode; at least one air groove is provided at the outer end surface of the assembly end of the battery rod, and is in one-to-one with and is adapted to be coaxial with the air hole; at least one protruding rib extending along the axial direction of the atomizer is provided on the outer circumference surface of the first outer electrode, and a locating groove in one-to-one correspondence with the protruding rib is provided in the inner wall of the electrode fixation base and extends along the circumference direction of the battery rod; and the protruding rib is rotatablely engaged with the locating groove, and is rotated in the circumference direction of the battery rod. In operation, the first outer electrode is inserted into the socket and mounted in the electrode fixation base, and the protruding rib is engaged in the locating groove and is rotated around a fixed axis along an extending direction of the locating groove, such that a coaxial locating between the air hole and the air groove is realized. A rotation angle of the protruding rib and an ultimate assembly position thereof could be limited by the locating groove, and thereby an accurate aligning assembly between the air hole and the air groove could be implemented stably in any assembly process between the atomizer and the battery rod.

The electronic cigarette device according to the present application has been described above in detail. Specific examples are used herein to describe the principle and implementation of the present application, and the description of the above embodiments is only for purpose of better understanding the method and spirit of the present application. It should be noted that, various improvements and modifications may be made by those skilled in the art without departing from the principle of the present application, and these improvements and modifications also fall within the protection scopes of the claims.

What is claimed is:

1. An electronic cigarette device, comprising an atomizer and a battery rod which are connected with each other, wherein a first outer electrode is provided on an assembly end of the atomizer, at least one air hole is provided at a rear of the first outer electrode, a second outer electrode is provided on an assembly end of the battery rod, a socket adaptedly fitted with the first outer electrode is provided on the second outer electrode, an electrode fixation base is provided inside the second outer electrode, and is provided coaxially with and is rotatable around a fixed axis with the first outer electrode, at least one air groove is provided at an outer end surface of the assembly end of the battery rod, and the at least one air groove and the at least one air hole are in a configuration of aligning assembly;

at least one protruding rib is provided on an outer circumference surface of the first outer electrode and extends along an axial direction of the atomizer, at least one locating groove is provided on an inner wall of the electrode fixation base and extends along a circumference direction of the battery rod and is in one-to-one correspondence with the at least one protruding rib, the at least one protruding rib is rotatablely engaged with the at least one locating groove, and is rotatable in the circumference direction of the battery rod;

wherein the first outer electrode and the socket each have an elliptical cross section, the number of each of the protruding rib and the locating groove is two, and the protruding ribs are flange sections located at long axis ends of the cross section of the first outer electrode; and a rotation angle of the protruding rib and an ultimate assembly position is limited by the locating groove to implement an accurate aligning assembly between the air hole and the at least one air groove.

2. The electronic cigarette device according to claim 1, wherein each air hole is in any one of the following shapes: round, square, ellipse, triangle, or polygon.

3. The electronic cigarette device according to claim 1, wherein a cross-sectional area of each air hole is ranged from 0.5 square millimeter to 4 square millimeters.

4. The electronic cigarette device according to claim 1, wherein a cross-sectional area of each air groove is ranged from 0.5 square millimeter to 4 square millimeters.

* * * * *